US008308341B2

(12) United States Patent
Garcia

(10) Patent No.: US 8,308,341 B2
(45) Date of Patent: Nov. 13, 2012

(54) MULTIPURPOSE LID, ESPECIALLY FOR LIQUIDS, INCLUDING PAINT CANS

(76) Inventor: Thierry Garcia, Rambouillet (FR)

( * ) Notice: Subject to any disclaimer, the term of this patent is extended or adjusted under 35 U.S.C. 154(b) by 1161 days.

(21) Appl. No.: 12/089,881

(22) PCT Filed: Oct. 13, 2006

(86) PCT No.: PCT/FR2006/002304

§ 371 (c)(1),
(2), (4) Date: Apr. 10, 2008

(87) PCT Pub. No.: WO2007/042680

PCT Pub. Date: Apr. 19, 2007

(65) Prior Publication Data

US 2008/0223810 A1 Sep. 18, 2008

(30) Foreign Application Priority Data

Oct. 14, 2005 (FR) ..... 05 10529

(51) Int. Cl.
*B01F 7/20* (2006.01)
*B01F 15/00* (2006.01)
*B65D 45/16* (2006.01)

(52) U.S. Cl. ..... 366/247; 366/347; 220/326

(58) Field of Classification Search ..... 220/315, 220/318, 319, 324, 326, 281, 323; 292/159; 366/347, 242, 244, 245, 246, 247, 248, 249
See application file for complete search history.

(56) References Cited

U.S. PATENT DOCUMENTS

| | | | | |
|---|---|---|---|---|
| 2,442,705 | A * | 6/1948 | Meyer | 292/303 |
| 3,704,007 | A * | 11/1972 | Kroeger | 366/248 |
| 4,022,344 | A * | 5/1977 | Roamer | 220/4.03 |
| 4,351,449 | A * | 9/1982 | Zobel | 220/318 |
| 4,893,723 | A * | 1/1990 | Seabolt | 220/570 |
| 5,199,788 | A * | 4/1993 | Stallings | 366/247 |
| 5,622,289 | A * | 4/1997 | Dedoes | 222/472 |
| 5,979,681 | A * | 11/1999 | PatrickJean-Luc Andre et al. | 215/216 |
| 6,126,048 | A * | 10/2000 | Bublitz | 222/570 |
| 6,149,023 | A * | 11/2000 | Palmer | 215/286 |
| 6,254,268 | B1 * | 7/2001 | Long | 366/139 |
| 6,419,385 | B1 * | 7/2002 | Walls | 366/247 |
| 7,431,183 | B2 * | 10/2008 | Keough et al. | 222/570 |
| 2003/0168456 | A1 * | 9/2003 | Tomasella | 220/257.1 |
| 2007/0095845 | A1 * | 5/2007 | Auer | 220/713 |
| 2008/0223810 | A1 * | 9/2008 | Garcia | 215/201 |
| 2009/0064868 | A1 * | 3/2009 | Cartossi | 99/337 |

FOREIGN PATENT DOCUMENTS

EP 1 510 363 A1 * 3/2005

* cited by examiner

*Primary Examiner* — Tony G Soohoo

(57) ABSTRACT

The invention concerns a lid (2) comprising a skirt (3) for covering the opening of a can (1), in particular a paint can. The invention is characterized in that the skirt (3) comprises a peripheral edge (30), at least one stud (71) formed in the edge (30) and elastically coupled to said edge (30), at least one lock (72) mounted sliding on said edge such that said lock may take up a locking position wherein said lock is adapted to retain said stud in a position for engaging the lid on the can.

24 Claims, 3 Drawing Sheets

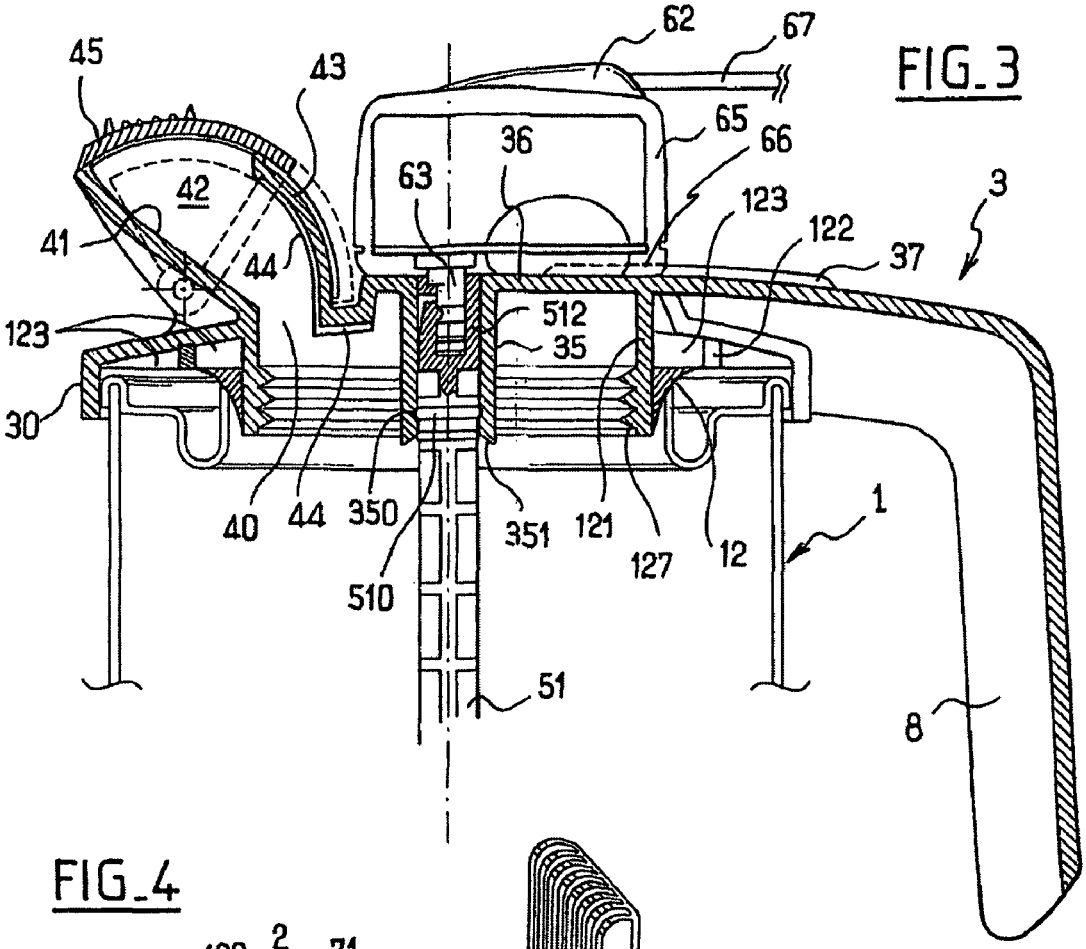
FIG_3
FIG_4
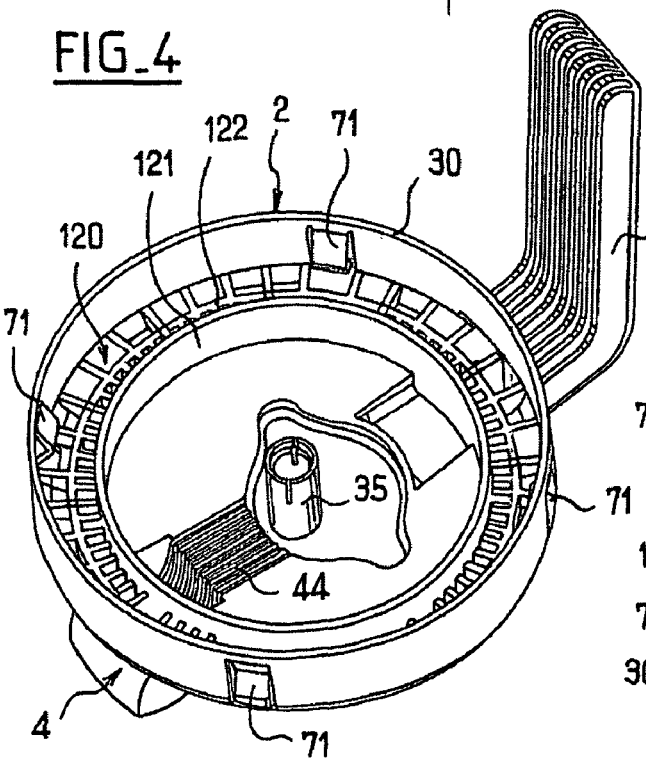
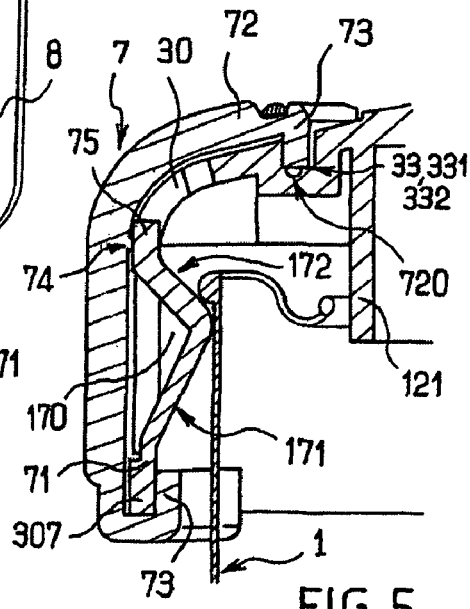
FIG_5

MULTIPURPOSE LID, ESPECIALLY FOR LIQUIDS, INCLUDING PAINT CANS

The present invention relates to a multipurpose lid, in particular, a removable and re-positional lid, adaptable to any type of metallic or plastic container, such as an existing paint can or an appropriate container for facilitating the use of such liquid products. The invention further relates to a lid, especially a stirring and pouring lid for preserving liquid products, such as paints, resulting in a significantly improved sealed container.

Hereafter, paint cans will only be referred to as typical examples of containers filled with liquid products in relation to the present invention. Within the scope of this invention, the use of paint cans has very few known developments, particularly for the general public, and their usage has not been efficiently facilitated by any accessories.

BACKGROUND

The problem of stirring and dosing paints, as described in U.S. Pat. No. 3,041,052, FR 2 555 141 or FR 2 536 044, has been previously considered. These patents disclose complex solutions of accurate dosating kinematics by the displacement of a plane shutter sliding on the spout vented by a cap in the section diametrically opposite to the spout, according to the pressure equilibrating principles designed to facilitate a surgeless liquid flow. In addition, any connecting systems between the stirring lid and the cylindrical paint cans are constituted with shafts mountable under the inner edge of a flange. These lids cannot be handled in a very ergonomic way and are reserved for the professional family specializing in body work as accurate dosating units. Furthermore, the use of a plane shutter presents a high risk of a possible trapped finger in the pouring spout area, on which a shutter may act as a guillotine with a very highly automated elastic force eventually leading to injuries of children caused by pressure or cutting action. Additionally, there are stirring lids intended for cans stocked in specific housing units. Each housing unit has its own motoring organs, inside a stirring table, designed to secure homogenization necessary to maintain good usable condition of paint at any time as described in patent EP 1 488 847. This very cumbersome stocking and stirring method is totally inappropriate for use in a domestic environment.

Moreover, environmental-friendly water-based paints became more popular in the year 2006, but their use is more complex, and they require additional user precautions. In particular, sedimentation occurs more quickly when paint comes in contact with air.

To partially thwart these problems and reduce the costs of stirring lids, numerous solutions of lids without cams appeared in the automobile industry, as disclosed in patents EP 0 511 041, U.S. Pat. No. 5,622,289, EP 1 153 844 or FR 2 836 204. Any of these stirring and dosing lids for paints have been developed towards mounting means external to the paint can without modifying the complexity of dosing method by plane shutter translation actuation or rocking kinematic means with inherent risks thereof. Additionally, venting through an air hole is generally existent.

More recently, the patent EP 1 510 363 describes a stirring and dosing lid for automobile body workers including a new swift fixation device to be mounted on the external edge of a typical paint can. This means of attachment comprising several elastic strips offers the advantage of allowing a greater diversity of can diameters to be accommodated, particularly in the automobile industry, while maintaining the very high efficiency of perpetual contact. It is effectively based on a blocking principle with a fish bone effect, as a harpoon which, once in place, will not allow the disengagement of the lid from the can, even if significant strength is applied in an attempt to remove it. On the contrary, the greater the effort of an attempt to extract the lid, the more difficult these attempts become. Thus the only way to withdraw the lid from the paint can is to manually activate the strip, in an opposite direction to the permanent elastic stress pressing it to the external surface of the can, in order to disengage it from the relatively weak outer edge. In fact, a tapered elastic joint shrewdly used in combination then facilitates the lid ejection effortlessly. Moreover, this elastic joint tends to compensate the variations of inner diameters of can flanges and lid deformations by better matching the inner edge of the flange and thus ensuring a good seal as it remains in contact with it, according to lift clearance principles. If these fixation means allow a more ergonomic usage in the lid positioning and release, they do not ensure in return a safety implementation necessary for a paint container resealed in a domestic environment, due to the possible presence of children, thus requiring an additional locking system designed to avoid opening too easily or ensuring adequate protection to prevent its accessibility.

Patent EP 0 515 032 clearly discloses the evolution of lids used for water-based paints in plastic containers which do not require further stirring and having a rocking plug. This system results in being inconvenient and not leak-free when in use. The dosing measurement can become inaccurate due to the rapid clogging of the pouring spout.

Patent EP 1 552 963, consists of a combination of traditional kinematics mounted on a base and to be screwed onto a bottle-shaped container. In this case, the efficiency of a dosing system comprising a sliding plug is universally recognized. But, this new kind of plug only functions as a dosing device and is developed with very cumbersome kinematics and a venting cap from lids commonly used in the automobile industry.

Moreover, patents CA 2 083 901, U.S. Pat. No. 6,419,385 or U.S. Pat. No. 5,199,788 reveal very rustic examples of lids conveniently used for large gallon-type containers. These stirring lids for paints are constituted of a disc adjustable to the different annular edges of a can. A leak-free state is obtained only by screwing the lid on the paint can. Moreover, the lid includes a large sized pouring spout equipped with a plug securely fixed thereon, then a stirring blade jointly coupled with a crank. Though such lids are very simple, they present numerous disadvantages for preserving and securing such devices in a domestic environment. In fact, the lid fixation system on the can offers no security, to the extent that in case of the paint can falling, the lid can be released from its fixation. Thus, the problem of container closure is no longer of regulatory efficiency for paints and does not meet the required standards.

Liquid paints, when sold in cylindrical cans, are generally covered with a disc fixed to the can, either by using strips folded down on the peripheral outer edge, sealing between the can and this disc being provided by a gasket compressed between the disc and the peripheral outer edge of the can, or by a disc compressed on the peripheral inner edge of the can flange, or directly on the can, sealing between the can and this disc being provided by a rigid fixture all around the inner flange or directly around the can circumference.

Once the disc is released, generally it is no longer possible to close the can again to the degree of the original seal, and paint, if not deployed rapidly, will be unusable, generally because the most volatile components evaporate or otherwise solidify. As it is necessary to completely remove the original disc in order to use the paint, this irremediably leads to its irreversible degradation within a short period of time, prejudicial to preservation for extended usage. Once such a can is open, it is not always easy to use the paint. Thus, if the paint needs to be poured into a more appropriate container, i.e. for applying paint with rollers, the paint has a tendency to run over the edge of the can, and forms a crust thereon.

Frequently opening and closing the original disc rapidly deteriorates the contact function with the can and sealing is no longer secured in static storage. Thus, storing paint for a sufficient period from a few hours to a few weeks, allowing the users to be able to work at their own pace from one weekend to the next one, is practically impossible. The infrequent user must buy a plurality of small amounts of paint, which is relatively expensive, or apply paint coats as rapidly as possible upon the can's opening. This situation is as critical as the volume of paint is important.

If the paint needs to be stored for a certain period of time, it should be mixed on a regular basis in order to maintain its homogeneity or to avoid its solidification when exposed to air. But, the degradation of paint by over-oxygenation from a rapid stirring action should be avoided. Therefore, the stirring cabinets for paint cans available for professionals are completely ineffective for individual users in one part because of the rotation speeds greater than 60 rpm of these machines and, secondarily, due to the intensive usage of gun-sprayed paints inducing a high rate of dye renewal. In the sector of decorative paints intended for personal use, the usage frequency rate is not only lower and less sustained, but also usually slower as the application is almost exclusively manual and consumption speed lessens.

SUMMARY

The goal of the invention is to offer a means of allowing easier usage and better preservation of canned paints, in particular for individuals or artisans.

According to the invention, such device includes a skirt to cover the can opening, including paint cans, wherein the skirt comprises a peripheral edge, at least one stud formed within said rim and elastically connected therein, and at least one slideable lock inserted in said rim allowing said lock to be in a locked position in which said lock is adjusted to secure the stud in an engaged position affixing the lid onto the can. Advantageously, the stud first comprises a relatively inclined ramp and is designed to interact with one rim of the can, so that when the lid is sealed onto the can upon a substantially vertical axis, the lock is radially and elastically detached from the edge of the can. Also advantageously, the stud may comprise a second ramp relatively inclined in a vertical orientation and designed to interact with one rim of the can, so that when the lid is substantially removed in an upward movement from the can, the lock is radially and elastically detached from the groove of said rim of the can. Thus, the lid can be placed or withdrawn with minimal effort, the stud being engaged by a simple snap-on motion. The locking device in its locked position verifies that the stud will then be maintained in its engaged position.

The lid can be conveniently equipped with a pouring spout. This allows easy pouring of the paint product into another container without removing the lid. This lid conveniently includes an upper surface and walls that define a channel connecting a first and a second aperture to facilitate the paint flow from the first to the second aperture. The upper surface may include grooves extending between the first and the second apertures. Conveniently, and to prevent them from being too easily clogged by the can contents, especially paint, the width of the grooves is lower than 5/100 of a mm. The upper surface may form a vault above the channel, thus preventing irregular flow. The grooves thus form a vent when pouring the contents from the can. Several grooves may be formed to provide a desired air flow rate. Such a vent may be closed simultaneously with the spout with the same single plug. No other additional piercing is required in the skirt for air flow.

The plug can be slidably mounted on the upper covering surface, between the open and closed positions for the second aperture. Conveniently, the spout comprises at least one magnetic plastic material arranged in a configuration for maintaining the seal of the plug, including liquid sealing, and conveniently, air sealing, when the plug is in the closed position. The upper covering surface may include a guiding means for the plug, extending outwardly from the spout, such upper covering surface additionally comprising means to mechanically block the plug in order to secure the plug in a leak-free capacity to the contents of the can, including liquids and, conveniently, air, while the plug is in the closed position. These blocking means may or may not be combined with the magnetic plastic material. These guiding means and plug blocking means together can constitute a guiding rail whose shape is such that when the plug is switched from the open toward the closed position, the plug is increasingly pressed against the second aperture.

The pouring spout may be designed to be removably mounted on the lid and may also incorporate means to be mounted on an orifice adaptation of the lid. Such a lid then allows coupling of such a spout to the skirt. In that case, the adjustment means may include a mounting orifice penetrating through the skirt and a cap for the sliding sealing of said orifice.

Such a lid may conveniently include a hatch allowing access between the inner surface and outer surface of the skirt. Such a hatch may allow the introduction of a brush into the paint can equipped with such a lid, without the necessity of disengaging the lid from the can. Conveniently, the hatch may consist of a translucent or transparent material, so that the contents of the can may be readily visible, especially to determine the color of the paint it contains, or to ascertain the quantity of the contents within.

A lid according to the invention conveniently comprises a stirring means for the contents of the can. These stirring means may include at least a propeller rotationally mounted inside the skirt and conveniently including in its distal end and its extension a flexible portion. This flexible portion, forming a scraper for scouring the bottom of the can, is conveniently biased relative to the blade rotation axis. Scraping elements can also be laterally provided to scrape the inner sides of the can.

Fixing means can include a tubular element that extends substantially axially within the lid and that comprises first snap-on means for the stirring means, for example an inner groove. The stirring means may include additionally a shaft rotationally mounted inside the tubing element and comprising second snap-on means, for example a pad for the snap-on action in the tube groove, the second snap-on means interacting with the first ones. Consequently, the stirring blade is removable and easily dismantled by a mechanical pressure on its axis, accessible outwardly from the skirt without any unwanted contact with the paint and before dismantling the lid.

Additionally, the tubing element and shaft conveniently each comprise a tapered surface, said tapered surfaces being complementary to each other and securely maintained in contact by the snap-on means, to create a sealed zone around the shaft.

The stirring means may include a blade shaft element extending outwardly, for rotationally driving the blades. The shaft element comprises a housing for motor elements, including a crank or a motor output shaft. This shaft element is flushed with or withdrawn from the outer surface of the lid, allowing in particular support of the motor upon this outer surface.

The motor means may incorporate a removable electric motor, and wherein the lid comprises a groove, the motor blocking means interact with said groove to prevent any motor housing rotation.

Preferably, especially for water-based paints, and for better conservation, the rotation speed for the stirring means, especially when they consist of two blades, may be selected to lower than 60 rpm, and preferably lower than 30 rpm.

For sealing between the skirt and the can, the lid may include a peripheral sealing gasket inside the skirt. This gasket can be substantially tapered and present the diameter of a sealing zone progressively reduced when extending from the skirt, and thus is designed to be substantially supported to the inner side of the can opening.

The lid may includes a screw-on mounting means, for example using threads, to be mounted on a can or a box providing an additional thread. The lid may incorporate both such mounting means and studs in order to be variously adapted to a can or a box, metallic or plastic for example, with or without threads.

From inside of the lid or the skirt, the side is inwardly oriented towards a can when the lid is in the use position. In the discussion that follows, it should be assumed that the can is placed on an horizontal surface and its top edge is itself substantially horizontal.

By using a lid according to the invention's design, the user does not have to worry any longer about the permanent opening or closing of the original disc. Once the lead accessory or lead assembly is placed on a paint can, the user then has effected a safe package allowing him all the necessary and possible uses for the proper preparation and manual application of the paint during its entire shelf life and further maximizing its applicable usage period, while causing the reduction of waste as an additional environmental benefit.

The invention prevents most of the contact between paint and air. Air exposition is only present when opening the pouring spout, thus constituting the only air intake during the pouring process. For this, the geometry of the pouring spout such as the one described in examples below, is adapted to substantially improve the liquid flow, at rapid or slow velocity, without any restriction from the can's inclination.

The invention facilitates a solid simplified lid assembly, dedicated to small paint conditioning, such as 0.5 or 2.5 L cylindrical cans ensuring a maximum storage life for the paint. This assembly can be re-used several times and offers several functions available to the general public. Painting activities, too often considered as unrewarding chores, can therefore become more attractive. One advantage is the great flexibility offered by the product which can be adjusted to most existing commercially available cans and which can offset the multiple constraints inherent to contact with paint in the frequent operations of pouring and/or mixing.

Moreover, a lid according to the invention can be easily adjusted to the diameters of cylindrical cans available. It can provide direct contact on the peripheral outer edge of existing cans when locked as well as when open, thus ensuring the total safety of the assembly. Furthermore, the locking means can reveal either visually or acoustically the closed status, and thus contribute to a feeling of safety by confirming a tight and secure seal.

A lid according to the invention allows comfortable usage, reinforcing the notion of painting as fun and makes ongoing decoration activities more enjoyable. For this, the means used are more compact than the sophisticated actual kinematics.

A lid according to the invention helps assure the storing of the paint in order to be able to work at one's pace, without any time constraints due to the rapid degradation of paint. The paint can then be stored for at least the period of time corresponding to the use-by-date recommended by the paint manufacturers (up to 1 or 2 years according to actual recommendations), and often even longer.

A lid according to the invention allows a switch between rapid stirring for immediate use and a slow stirring for storing water-based paints without causing degradation. Consequently, the axis of the stirring blade may accommodate a crankshaft or a standard small sized commercially available gear motor.

Finally, the invention offers a lid whose geometric structure design, more aesthetic and very cost-effective, provides a great rigidity for a very good sealing of the assembly, combined with a simple fixing system without producing significant mechanical stress on the can.

Additional specificities and advantages of the invention will be outlined in the following description in relation to non-exhaustive examples.

BRIEF DESCRIPTION OF THE DRAWINGS

In the annexed drawings:

FIG. 3 is an axial and vertical cross-sectional view of the lid as shown in FIG. 1;

FIG. 4 is an inside view of the lid shown in FIGS. 1 and 3;

FIG. 5 is a detailed and vertical sectional view of a peripheral edge of the lid according to the invention, to the right of a stud, the lock being in the locked position;

DETAILED DESCRIPTION

Figure 1:
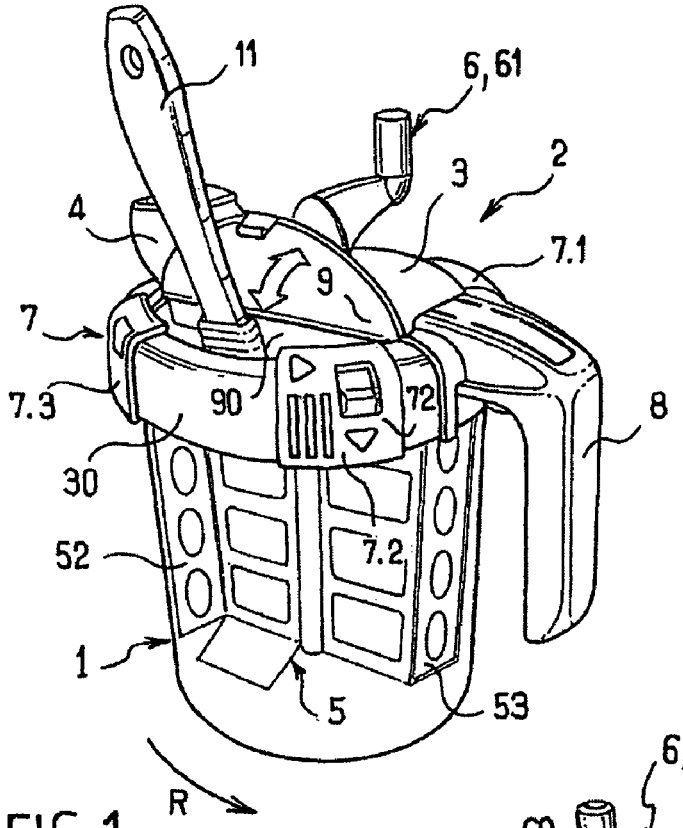
FIG. 1 is a perspective view, from slightly above, of a paint can equipped with a first embodiment for the lid according to the invention, a brush being introduced through a hatch designed into the lid and the stirring means being transparently visible within the can.
Figure 2:
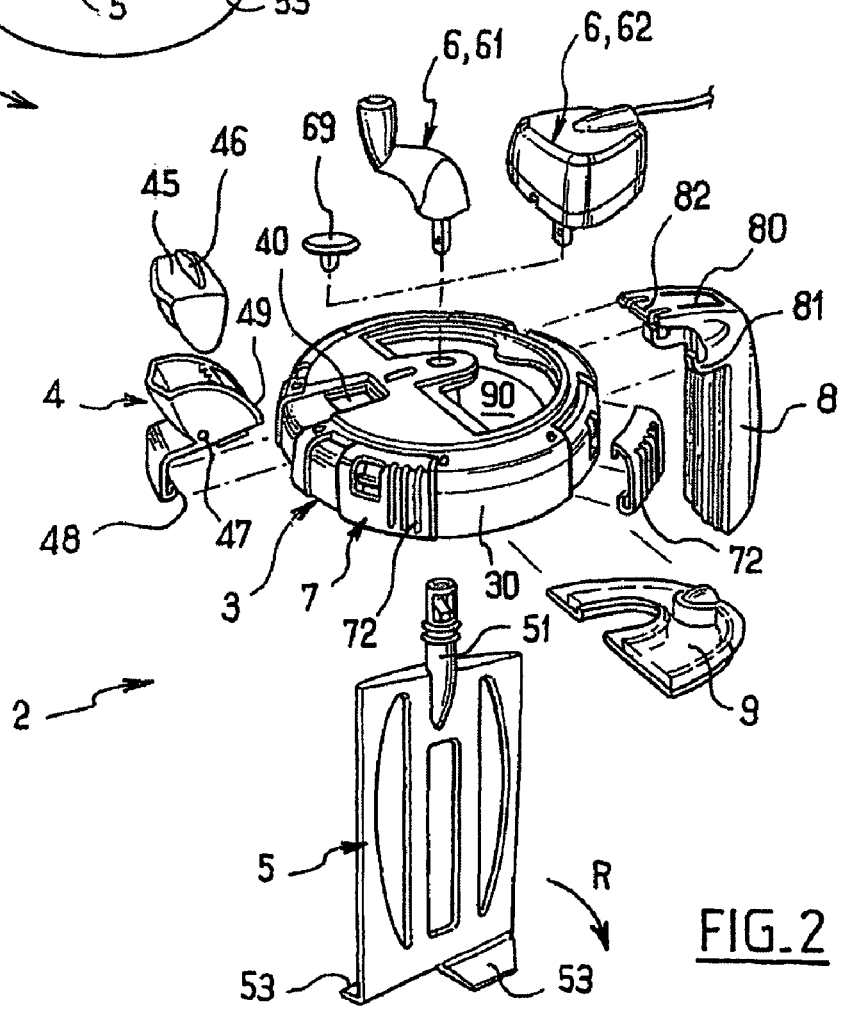
FIG. 2 is an exploded view, from a same angle, of a second embodiment for a modular lid according to the invention.

FIG. 1 represents a paint can 1 equipped with a lid 2 according to the invention, as represented in a first embodiment. FIG. 2 represents an exploded view of a second embodiment, for a modular lid according to the invention. Lids of FIGS. 1 and 2 comprise mainly a skirt 3 to substantially cover the opening of the can. A pouring spout 4 is mounted on the skirt 3, to allow the pouring of paint without removing the lid of the can 1. Stirring means 6,5, including blades 5 extending inside the can 1 and motorized means 6 for propelling blades (here, a crank 61), is axially mounted on the skirt 3. In addition, the lid 2 comprises locking means 7, 7.1,7.2,7.3 mounted on a peripheral edge 30 of the skirt 3 to attach jointly the lid on the can and a handle 8 to allow the can to be lifted when the lid is integrally fitted. The lids shown in FIGS. 1 and 2 also include a hatch 9 accessed through an opening 90 in the skirt 3 to allow access inside the can without requiring the lid's removal from the can. As particularly shown in FIG. 1, this hatch is advantageous for the entry and usage of a brush 11 in an upright position inside the can 1.

In the embodiment seen in of FIG. 2 the lid is modular, i.e. assembly parts, including the spout 4, the stirring means 5,6, the handle 8 and the hatch 9 are designed as to be removable. Thus, only the skirt of the lid can be used if only enclosing the can is desired, or one or more elements can be added, if needed. If the lid is sold without elements mounted on the skirt, the lid can be provided with caps (not shown in figures) to seal the orifices 40,90 designed for the respective assembly of the lid and the hatch. Likewise, a plug 69 can be inserted for sealing an orifice of the stirring means 5,6. If one wants to use a pouring spout 4 or a hatch 9 on the lid 2, one simply removes the corresponding cap and mounts the assembly elements 4,9 selected on the orifices 40,90 thus released. These assembly elements can be transparent or translucent to visibly observe the paint.

In the embodiment shown in FIGS. 1 and 3, the spout and the handle, in particular, are not designed to be removable. They are firmly attached to the skirt.

The hatch 9 is half-moon shaped, from which one semi-circle edge follows the peripheral edge of the 30 of the skirt. It is pivotally articulated along an axis supported by the string of said semi-circle. The hatch consists of a transparent material revealing the color of the paint inside the can without opening it. The hatch is arranged in such a way that when it is in the closed position, it can ensure a level of sealing comparable to that of the plug 45. In the embodiment shown in FIG. 2, the hatch extends beyond the diameter of the skirt, thus allowing it to clear the center of the skirt, where mounting the stirring means is planned.

For the attachment of the lid 2 on the edge of the paint can, the skirt 3 includes the peripheral rim 30 extending substantially downwards. The locking means 7 allow the coupling of the lid on the can while accepting some variation in the outer diameter tolerance of the can aperture. Commercially available cans being standardized, only a lid model for each can size is required. Thus, the required tolerance will generally follow manufacturing tolerances. However, the possible contact for the lid with the edge of the can is very low (approximately 5/10ths of a millimeter) comparatively to the outer diameter of the can. Providing stiffening members 120 thus may be important (see FIG. 4). In the embodiment shown in FIG. 4, stiffening members 120 comprise two cylindrical and coaxial walls 121, 122, substantially parallel to the peripheral edge 30 of the lid. The cylindrical walls extend downward from the inner face of the lid. They are joined together with the peripheral edge 30 by several radial stiffening elements 123. The radial stiffening members extend downwardly from the inner face of the skirt, as far as the wall 122. They are more numerous, twice as many in the example shown, between the two cylindrical walls 121,122 than between this wall 122 and the peripheral edge. The wall 121 extends downwardly beyond the radial stiffening members 123. Such an arrangement allows, especially for lids, including those in plastic material, to ensure that a radial deformation of the peripheral edge 30 will not exceed 1/10th millimeter. Consequently, the stiffening members 120 form therebetween cavities strengthening the rigidity of the lid.

The cylindrical wall 121 has an inner thread (see FIG. 3) provided to be adapted on a complementary thread from other paint cans. This lid can then be variously used with a paint can 1 without complementary thread as shown in FIG. 3, or with a can (not shown), where the aperture includes a complementary thread.

The cylindrical wall 121 defines a central area, substantially horizontal herein, in which a hatch 9 opens (see FIGS. 1 & 2).

The locking means 7 will now be described with reference to FIGS. 5 and 6(*a*)-6(*c*). The locking means comprise four studs 71 located at a regular distance on the peripheral edge 30 and for each stud a respective lock 72.

Figure 6A:
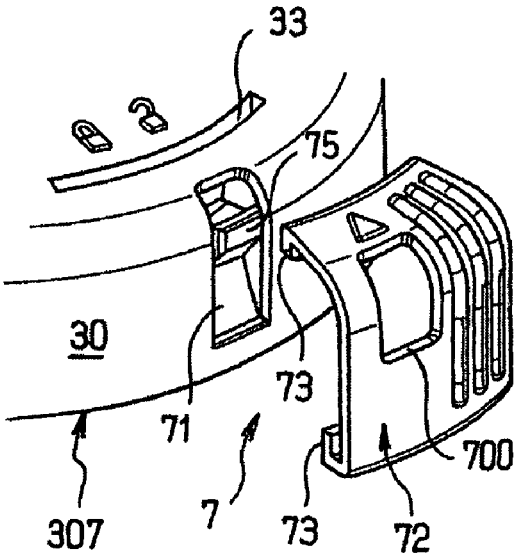
FIGS. 6(*a*)-6(*c*) are detailed perspective views of the peripheral edge and the lock of FIG. 5; and, FIGS. 7(*a*) and 7 (*b*) are views of a spout according to the invention for a lid according to the invention, respectively, with and without its plug.
Figure 6B:
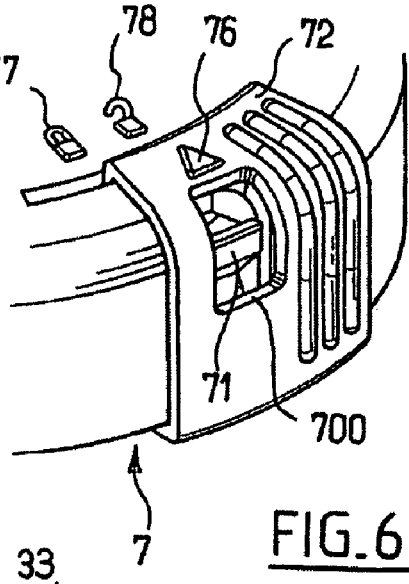
Figure 6C:
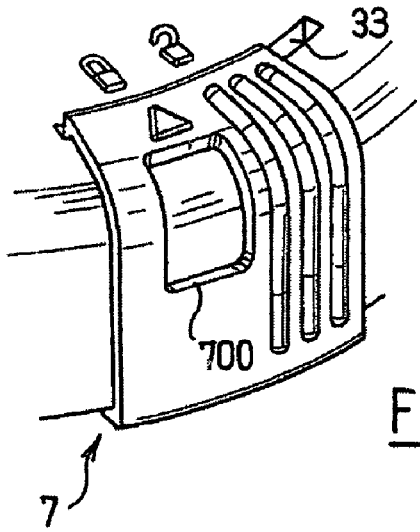

FIG. 6(*a*) is an exploded perspective view of the locking means. The locking means in an unlocked position are illustrated in FIG. 6(*b*). Locking means in a locked position are illustrated in FIG. 6(*c*).

As particularly shown in FIGS. 5 and 6(*a*), studs are formed within the peripheral edge 30 and are coupled therein in their lower portion by an elastic portion as shown in the example. The lock 72 is slidably mounted on the peripheral edge with two rails 73 formed in one single part with the lock and operating within a groove 33 on the top of the skirt and the other with the inside of the lower edge 307 the peripheral edge 30.

The stud 71 comprises a dihedral 170 constituted of a first ramp 171 and a second ramp 172, relatively inclined in a vertical orientation, the first ramp 171 under the second ramp 172 allowing the dihedral edge 170 to be horizontal, at the junction of the two ramps. This edge is sufficiently circular, in order to be substantially parallel to the peripheral edge 30 of the skirt, thus, in its usage position, at the edge of the paint can. The dihedral is located next to the free upper end of a stud, at a distance from and opposite to its lower portion forming a contact with the peripheral edge 30. Additionally, the dihedral radially extends inwardly to the skirt 3, allowing the edge to extend beyond the inner face of the cylinder generally formed by the peripheral edge 30.

Therefore, during the substantially vertical driving of the lid onto the can, the first ramp 171 interacts with the edge of the can 1, so that the stud is radially and elastically released at the passage of said edge of the can. Likewise, when the lid is substantially removed in a vertical direction from the can, the second ramp 172 of the stud is radially and elastically released upon the passage of said edge of the can.

Since the dihedral radially extends inwardly to the skirt 3, when the lid is in position on the can, the stud being in a substantially elastically and relaxed position, the second ramp 172 is disposed under the edge of the can 1. As illustrated in FIG. 5, the lower portion 171 inclination, relatively in a vertical orientation, forms a sharp angle of approximately 30° while the upper portion 172 inclination forms a greater angle of approximately 45° compared to the vertical orientation. Thus, closing the lid is easier than its removal. A substantially stronger elastic stress ensures the lid studs will securely and strictly maintain contact under the outer edge of the can.

The lock 72 comprises an horizontal flange 74 extending from an inner face of the lock, opposite the peripheral edge 30. The flange constitutes a sliding support for the lock on the outer side of the peripheral edge 30. Additionally, the lock comprises a window 700 disposed in such way that the flange 74 is discontinued for the width of said window. In a locking position such as shown in FIGS. 5 and 6(*c*), the flange 74 is supported on the upper open end 75 of the stud. In this locked position the lock exerts no substantial strain on the stud. The flange limits the stud movement though, so the stud cannot be radially released at the edge of the can and remains engaged therewith. The lid so locked is thus safely maintained on the can.

There exists a position for the lock, as shown in FIG. 6(*b*), that defines the unlocked position, for which the stud 71 is opposite to the window 700. With the window being larger than the stud, measured in horizontal orientation, and the flange being discontinued by the window, in this position the stud can be freely released at the edge of the can.

When the handle is removed for interchangeability, the contact is operated at one end by a rail 82 according to an elastic mode within a groove on the skirt 3 and at the other end by a second rail 81 forming one piece with the handle 8 engaged on the peripheral edge 30.

In addition, the window allows a user to very easily see if the lock is in an unlocked position, when the respective stud is visible, or locked when the respective stud is concealed by the lock itself. Alternative visualization means are also provided. They consist of arrow-shaped marks 76 on the lock, and two other marks respectively representing a locked padlock 77 and an open padlock 78. In the locked position, the arrow 76 is facing the locked padlock 77. In the unlocked position, the arrow 76 is facing the open padlock 78.

The locking/unlocking actions are designed so that they can be operated in one action with both hands. Thus, the four locking elements can be mounted in an opposite two-by-two arrangement, in order to have the thumb and the index of the same hand being respectively placed on two neighboring lock elements, bringing two fingers together triggers the locking process, and moving them apart will trigger the unlocking process.

Conveniently, the sliding lock elements include indexing notches 720 on one rail end 73 in the form of a small circle integrating with two additional cavities within the groove 33 corresponding to the lock elements support of said locks in their extreme closed and open positions. This indexing process ensures that the lock will be kept in place in order to avoid an unexpected displacement, especially in the case of a fall.

Additionally, the mechanical strength of friction and elastic deformation generates an uncoupling movement along with an audible stopping sound. This sound is a data return on the efficiency of the user's action in addition to visual verification.

A tapered joint 12, narrower in its lower portion and wider in its upper portion is mounted against the stiffening members and attached to the wall 121, under the skirt 3. Such a tapered joint allows the lid to lid pre-center itself inside the edge of the can 1, then, once the locking process is performed, to ensure a good sealing of any air and liquids between the skirt and the can. It also accommodates the potential clearance between the studs 71 and the edge of the can 1.

The pouring spout 4 of the invention will now be described, especially in reference to FIGS. 7(*a*) and 7(*b*). The pouring spout comprises a channel for paint flow, the channel being constituted of a bottom element 41 and two lateral walls 42. The bottom element 41 is substantially inclined with an angle of 45° in conjunction with horizontal plane, and extends upward from an edge of the orifice 40 until substantially plumb with the peripheral edge 30 of the skirt 3. The lateral walls 42 substantially extend in a vertical and plane orientation above and about the bottom 41. In addition, the spout 4 comprises an upper wall 43 extending from an opposite edge of the orifice 40. The two lateral walls 42 extend from the bottom 41 to meet the upper covering wall 43. The spout thus forms a first inlet opening matching with the orifice 40 and a second opening for the spout outlet end, in the can-draining direction. As illustrated in the example, the opening is formed within the central area of the skirt. It is then substantially horizontal.

As shown in FIG. 3, the pouring spout is preferably circular, having a plug with a curvilinear motion in order to limit the blocking of extreme opened and closed positions. The advantage is a significant reduction of the plug motion amplitude, contrary to existing plug systems, while maintaining an identical maximum spout opening for any dimension can. Consequently, the pouring spout may be installed on small cans of 0.5 or 1 liter, when available space is very limited, without reducing the quality of the pouring product. The necessary space is equal only to the thickness of the plug 45 when in the maximum opened position.

Figure 7A:
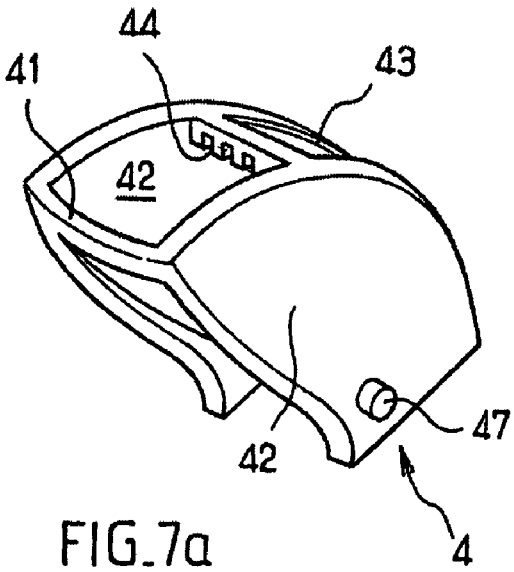
Figure 7B:
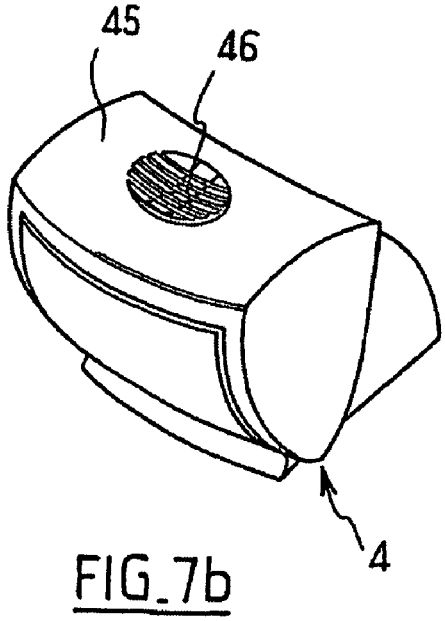

The mobility of the plug may be provided by mechanical means or manually as shown in FIGS. 2 and 7(*b*) by using a gripping area 46.

Additionally, the plug 45 is mounted rotably articulated about the lateral walls 42 and designed to completely close the second opening. Furthermore, the plug is maintained about lateral walls 42 by a pivot 47 thus securing it if dropped. In order to secure an efficient closing, including proper sealing to liquids and preferably to air, the spout consists of magnetic plastic materials arranged in a way they tend to maintain the plug in its optimum closing position. Conveniently, the channel, upper wall and plug can all be composed completely of the same magnetic plastic material.

When the pouring spout is removed for its interchangeability, the sealing contact is performed mechanically according to the principle of a cone within a cone. The pouring spout has a rail 49 at one end horizontally or vertically engaging a groove on the skirt 3, and at the other end a rail 48, two rails 48,49 forming a single piece with the pouring spout 4 with a grip on the peripheral edge 30.

One inner face of the spout from the upper wall 43 comprises grooves 44 substantially extending parallel to the lateral walls, between the first opening and the second opening of the spout. These grooves extend to the inner face of the lid. These grooves conveniently have a maximum width of a few hundredths of millimeters, so the paint cannot penetrate and cannot block them, thus allowing ample circulation between the inside of the can and ambient air and conveniently replacing the need for a vent. In fact, when the plug is in a locked position, the grooves and the channel are simultaneously occluded, creating a guaranteed seal. This is not the case with a vent formed in the skirt of a lid which should be individually occluded when in the neutral position and presents risks of leakage during the pouring process.

The upper wall 43 forms a vault, i.e. it is concave from the inside of the spout respective to where it first moves away from the bottom 41 as it moves away from the first opening to the second opening. Surprisingly, it seems that the spout disposition, combining the vault-shaped grooves, avoids the 'hiccup' effects which sometimes project liquids, e.g. paint, by fits and starts out of the spout, resulting in splashing.

The stirring means will now be described, particularly in reference to FIGS. 1, 2 and 3.

These stirring means include mechanical means which can be a crank 61, as shown in FIG. 1 or 2, or an electric motor 62, as illustrated in FIG. 2 or 3. Additionally, they comprise a blade 5 (FIG. 2) or blades 5 (FIG. 1), attached to a shaft 51.

For mounting the stirring means, the lid comprises a fixed platform for the stirring means. The fixing means include a tubular element 35 substantially extending along the axis inside the lid from the skirt 3. The tubular element is open at each of its ends, respectively inside and outside the lid. If the lid is used without the stirring means, a removable plug 69 can be provided to guarantee the sealing of the lid. The tubular element 35 is provided to function as a rotational bearing for the shaft 51.

The tubular element 35 comprises snap-on means, herein a groove 350 arranged in an inner wall of the tube, combined with a matching pad 510 on the shaft 51. Additionally, the tubular element 35 includes at a distal end to the skirt a lip with a substantially tapered surface 351 accommodating a complementary tapered surface located on the shaft 51. The tapered surfaces are maintained under pressure by an efficient arrangement of the snap-on means 350,510. They constitute a sliding support during the rotation of the stirring means and together provide a sealing surface between the inside and outside of the lid when the blades are mounted on the lid.

In the embodiment shown in FIG. 1, there are two blades 5 and each comprises a main plane, both planes substantially coplanar extending about the shaft 51. These planes are horizontally and vertically extended by scrapers 52,53, respectively to scrape both sides and bottom of the can. The scrapers may be flexible and/or resiliently articulated with the main planes. This flexibility and/or articulated configuration therefore allows one to adjust the width of the blades to a certain variation of dimensions between the can and the blades, due in particular to manufacturing tolerances. To provide an efficient scraping process, scrapers are oriented from the planes, according to a rotational direction R of the blades so the contact with the paint on the scrapers allows pressure on their respective scraping edges against the can. Furthermore, the blades are permeated with holes in order to limit rotational resistance and facilitate flow of the paint.

In the embodiment shown in FIG. 2, the single blade 5 is mounted at a lower end of the shaft 51 shorter than the one presented in FIG. 1. It does not allow scraping on the sides, only providing scrapers 53 for the bottom. This scraper allows adjustment of the blade to the depth of the can, which can vary. It also absorbs vibrations in the bottom of the can, when the blade is removed while the lid is still on the can.

The upper end 512 of the shaft 51 is designed to connect to a drive shaft 63, whether from an electric motor 62 or from a crank 61.

Consequently, the user can change swiftly change the driving method of the stirring blade, manually or automatically, based on his needs, either a rapid stirring for an immediate use with a crank functioning at a speed up to 200 rpm or slow stirring for a long term storage with a motorized speed lower than 60 rpm. The advantage of this dual use is really intended to respond to the major concern of individuals as to know how they can preserve their paint, usually perishable, once the original disk is removed. This system contributes to environmental preservation by a reduction of waste due to longer paint shelf life. The user is allowed re-usage of the paint after a substantial storage period.

The crank has a sufficiently wide base to provide a good seat and the radius of rotation is defined to prevent overcoupling of the forces applied by the user.

As specifically indicated in FIG. 3, a platform 36 is provided for the skirt 3 for positioning the motor on the lid. The end of the shaft 51 is intended to be recessed from the platform, inwardly towards the lid, so the drive shaft 63 can advance through the skirt to the tubular element 35 and the shaft 51 when the motor 62 is supported on the platform 36. A rib 37 is included on the platform 36, complementary to a groove 66 in the housing 65 of the motor 62, allowing the rib 37 and the groove 66 to fit together and prevent the relative rotation of the skirt and the housing around the driving shaft 62.

Conveniently, controlling means, not shown, are intended to operate the motor at regular intervals, each time for a selected duration, sufficiently and lengthy enough to maintain homogeneity of the paint. The power consumption is thus relatively low, the motor shown in FIG. 3 is fed by a wire 67 connectable to wall power, but can also be operated with batteries.

The controlling means can also be configured to operate several motors, each fitting a respective lid.

The crank shown in FIGS. 1 and 2 is designed with the same end fitting as the shaft 63 of the motor in FIG. 3, so that the same lid 2, motor 62 or crank 61 can be used interchangeably.

The invention is of course not limited to the examples previously described and a plurality of arrangements can modify these examples, and yet remain within the scope of the invention.

Additionally, the paint, a pouring spout or a lid according to the invention can be used, for example, with a varnish can, or other technical products. The invention can furthermore be used with other products, e.g., food products. In particular, an agitator lid according to the invention can be adapted for the preservation of emulsified food liquids.

All or part of the accessories can be provided on the lid. In particular the blades can include the scrapers, or only some of them. For example, the blade can be provided with scrapers only for the bottom of the can.

The joint instead of being tapered can be flat, e.g., foam and adhesive, gripping on the upper edge of the can, and can be mounted on the radial stiffening members.

The hatch may include a blade axis to potentially ensure a greater accessibility to the paint. In that case, the opening can be extended all along the central surface delineated by the cylindrical surface to the right of the pouring spout. Especially in this configuration, the hatch can additionally be snapped-on instead of being articulated to the skirt. When the hatch is retracted, the skirt is substantially reduced to an annular crown, whose arrangement is particularly favorable to the transfer of fluid from one container to another.

The lock can be adjusted to accommodate the elastic stud displacement.

The invention claimed is:

1. A lid adapted to cover a container opening, comprising:

a skirt adapted to enclose the opening, the skirt having a peripheral rim, a stiffening member adapted to inhibit radial deformation of the lid, and plural studs dispersed along the peripheral rim; and at least one lock coupled to the rim, the at least one lock sufficient to lock each of the plural studs in engagement with the container, each lock moveable toward a locking position in which the lock is adapted to retain the at least one of the plural studs in engagement with the container and moveable toward an unlocking position in which the lock permits movement of the at least one of the plural studs away from engagement with the container.

2. A lid according to claim 1, the lid adapted to cover a container which is a cylindrical can, having a substantially circular periphery, and wherein:

each lock is adapted to permit elastic deformation of the stud away from the substantially circular periphery when in the unlocking position to permit both attachment of the lid to the container and removal of the lid from the container.

3. A lid according to claim 1, wherein each stud comprises a ramp relatively inclined in a vertical orientation, such that when the lid is engaged with the container in a substantially vertical movement, the stud is radially and elastically deformed away from the rim.

4. A lid according to claim 1, wherein each stud comprises a ramp relatively inclined in a vertical orientation and adapted to engage a rim of the container opening, such that when the lid is disengaged from the container in a substantially vertical movement, the stud is radially and elastically deformed away from the rim.

5. A lid according to claim 1, further comprising a mounting mechanism to attach a removable spout.

6. A lid according to claim 5, wherein:

the lid further comprises an orifice; and the mounting mechanism includes a groove in the lid adapted to receive the removable spout and retain the removable spout adjacent the lid, and at least one locking rail to retain the removable spout in registry with the orifice.

7. A lid according to claim 1, wherein:

the lid further comprises a spout;

the spout includes a first aperture to communicate with the container and a second aperture serving as an outlet; and the spout includes at least one groove extending between the apertures and beyond the first aperture, under the skirt.

8. A lid according to claim 1, wherein:

the lid further comprises a spout;

the lid further comprises a plug movable between an open position and a sealing position; and the spout comprises at least one magnetic plastic material adapted to magnetically bias the plug toward the sealing position when the plug has been moved toward the sealing position.

9. A lid according to claim 1, further comprising a rotational input mechanism accessible via the lid, the rotational input mechanism coupled to a stirring mechanism to permit stirring of contents of the container.

10. A lid according to claim 9, wherein:

the rotation input mechanism comprises first snap-on means to permit detachable connection of the stirring mechanism;

the stirring mechanism is adapted to sit within the container when the lid is engaged with the container, the stirring mechanism having an input shaft adapted to receive drive impetus from the rotational input mechanism, the shaft mounting a second snap-on means adapted to matingly-engage the first snap-on means to transfer rotational impetus from the rotation input mechanism to the input shaft, the first snap-on means and second snap-on means adapted to permit selective attachment and detachment between the stirring mechanism and rotational input mechanism; and the rotational input mechanism is adapted to engage and receive the drive impetus from a source external to the container when the lid is engaged with the container.

11. A lid according to claim 1, further comprising a stirring mechanism, including at least a propeller rotationally mounted within the skirt, wherein the propeller includes a flexible extension member to the propeller, the extension being mounted in at least one of (a) a radial outward direction, with respect to an axis of rotation of the propeller, or (b) a direction perpendicular to the radial outward direction.

12. A lid according to claim 1, further comprising a drive shaft element to receive at least one of a crank shaft or a motor output shaft.

13. A lid according to claim 1, further comprising a gasket inside the skirt, said gasket comprising a sealing surface designed to ensure a leak-free contact with a paint can.

14. A lid according to claim 1, adapted for use with a paint can, the lid further comprising a hatch allowing the communication between the inner surface and outer surface of the skirt, the hatch pivotally mounted by the lid and sized in a manner adapted for selective insertion of a paint brush when the hatch is moved to an open position.

15. A lid according to claim 14, wherein the hatch is transparent.

16. The lid of claim 1, the lid adapted to cover a container which is a cylindrical can, having a substantially circular periphery, and wherein:

the plural studs comprise at least three studs, dispersed around the substantially circular periphery;

the stiffening member comprises at least one coaxial wall substantially parallel to the rim, and radially displaced therefrom, and at least one radial structure extending between the at least one coaxial wall and the rim to inhibit radial deformation of the rim relative to the at least one coaxial wall.

17. The lid of claim 1, wherein:

the skirt and the stiffening member form a three-dimensional structure that strengthens rigidity of the lid; and the lid further comprises a handle mounted in fixed relation to the skirt, the handle adapted to carry lid both engaged and disengaged with the container.

18. The lid of claim 1, wherein:

each of the plural locks comprises a slidable lock movable between a locking position, in which the slidable lock inhibits elastic deformation of the stud away from the container, and an unlocked position, in which the slidable lock does not inhibit elastic deformation of the stud away from the container; and each stud further comprises two vertically-oriented ramps, including a first ramp and a second ramp, the first ramp adapted to elastically deform the stud away from the container as the lid is engaged with the container, the second ramp adapted to elastically deform the stud away from the container as the lid is disengaged from the container.

19. A lid adapted for use with a cylindrical container having an opening, comprising:

a cover portion adapted to cover the opening and a skirt at a substantial periphery of the cover portion, the skirt extending in a substantially normal direction to the cover portion and adapted to enclose an end of the container; and a plurality of tabs adapted to be deformed in a radial direction for selective engagement and disengagement of the lid with the container;

a locking mechanism comprising at least one lock moveable toward a locking position, in which the lock inhibits elastic deformation of at least one corresponding tab away from the container, to thereby resist disengagement of the lid from the container, and an unlocking position in which the at least one corresponding tab permits elastic deformation of the at least one corresponding tab away from the container to it disengagement of the lid from the container;

wherein the lid further comprises a stiffening member adapted to inhibit radial deformation of the lid, the stiffening member cooperating with the locking mechanism to inhibit removal of the lid unless each lock is in the unlocking position, such that each tab permits disengagement of the lid from the container.

20. A lid according to claim 19, wherein each lock includes a sliding mechanism adapted for a sliding motion to move the lock between the locking position and the unlocking position.

21. A lid according to claim 19, further comprising:

a rotational input drive shaft; and at least one stirring blade mounted within the skirt, the stirring blade mounted to lie within the container when the lid is engaged with the container, the stirring blade coupled to the rotation input drive shaft and adapted for stirring contents of the container when the lid is engaged;

wherein the stirring blade is adapted to provide stirring action when the input drive shaft is rotationally driven.

22. A lid according to claim 19, further comprising a spout, wherein the spout further includes a plug and anti-splash means to reduce splashing, at least when the plug is in an open position.

23. A lid adapted for use with a cylindrical container having an opening, comprising:

a cover portion adapted to cover the opening and a skirt at a substantial periphery of the cover portion, the skirt extending in a substantially normal direction to the cover portion and adapted to enclose an end of the container, the lid further having a stiffening member adapted to inhibit radial deformation of the lid;

the skirt mounting a plurality of tabs and corresponding sliding locks at intervals adjacent the periphery, each tab adapted to be deformed in a radial direction to permit selective engagement and disengagement of the lid with the container, each sliding lock moveable toward a locking position, in which the lock inhibits deformation the corresponding tab away from the container, to thereby resist disengagement of the lid from the container, and an unlocking position in which the at least one corresponding tab permits deformation of the corresponding tab away from the container to permit disengagement of the lid from the container;

a mechanism operable to receive rotational drive impetus from outside the lid and container when the lid is engaged with the container, and to transfer the rotational drive impetus to a stirring mechanism within the container.

24. The lid of claim 23, wherein the plurality of tabs comprise four tabs arranged as opposing pairs of tabs, and wherein the sliding locks slide corresponding to the tabs in each opposing pair slide in opposite directions to respectively move toward the locking position and the unlocking position.

* * * * *